US006784849B2

(12) United States Patent
Benco

(10) Patent No.: US 6,784,849 B2
(45) Date of Patent: Aug. 31, 2004

(54) CONCAVE ANTENNA WITH IMPROVED GAIN DROP-OFF CHARACTERISTICS RELATIVE TO ANGLE OF RECEIVED WAVEFRONT

(75) Inventor: David S. Benco, Winfield, IL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 10/320,229

(22) Filed: Dec. 16, 2002

(65) Prior Publication Data

US 2004/0113859 A1 Jun. 17, 2004

(51) Int. Cl.[7] ..... H01Q 19/12
(52) U.S. Cl. ..... 343/840
(58) Field of Search ..... 343/840 R, 781 R, 343/916, 715, 816, 818, 837

(56) References Cited

U.S. PATENT DOCUMENTS 6,094,174 A * 7/2000 Knop et al. ..... 343/781 R
6,181,289 B1 * 1/2001 Matsui ..... 343/781 R
6,215,453 B1 * 4/2001 Grenell ..... 343/840
6,323,822 B2 * 11/2001 Cook et al. ..... 343/840

* cited by examiner

*Primary Examiner*—James Vannucci
*Assistant Examiner*—Minh Dieu A

(57) ABSTRACT

Paraboloidal antennas are common for very high frequencies (VHF) and into the cellular telephone systems and personal communication systems (PCS). Paraboloidal antennas are often used at the base station of either cellular telephone antennas, PCS antennas or both. To avoid possible channel drop out because a sharp focal point of the antenna is misaligned by improper installation or harsh weather conditions. For base stations for cellular telephone systems and/or systems, PCS, a generally paraboloidal antenna that has a less sharp focal point so there is a antenna lower gain, but less relative signal degradation because of weather or other misalignment of the antenna. In such cases, the lower gain, but higher immunity to drop-out more than justifies such arrangements.

24 Claims, 2 Drawing Sheets

CONCAVE ANTENNA WITH IMPROVED GAIN DROP-OFF CHARACTERISTICS RELATIVE TO ANGLE OF RECEIVED WAVEFRONT

BACKGROUND OF THE INVENTION

This invention relates to antennas and, more particularly, to reflecting antennas with concave reflectors.

The use of paraboloidal antennas for microwave transmission and reception is well known. Paraboloidal antennas are used because of directional attributes and high gains that occur at the focal point of the parabola-of-revolution. Omni-directional electromagnetic energy emitted at the focal point of a paraboloidal antenna will be reflected as collimated radiation. Similarly, electromagnetic energy traveling on an axis parallel to the axis of a paraboloidal antenna, such as a far field omni-directional or laser/maser source, impinging upon a paraboloidal antenna will be reflected to the focal point. The incoming electromagnetic energy is focused to a very compact focal point.

The general equation for a paraboloid is: $z^2/a^2+y^2/b^2=x$. A representation of such a paraboloid is shown in FIG. 1. Considering the plane where z=0 then $y^2/b^2=x$ or $y^2=b^2x$ and for such an equation the focus of the parabola in the plane where z=0 equals b/2. This focal point is the same distance for any of the planes containing the x-axis. The x-axis is the axis of symmetry.

The concentration of the received energy at the focal point is a good way of achieving high gains. The high gain region is located tightly around the focal point of the paraboloidal antenna. The tightness of that focal point also has some disadvantages. An installation with the axis of symmetry of the paraboloidal antenna not parallel to the incoming signal will cause a sharp signal drop-off if the angle between the axis of symmetry and the incoming signal increases. Similarly, high wind or icy weather can affect the effective gain of a paraboloidal antenna by deflecting the axis of symmetry from the direction of an incoming signal. Electromagnetic energy coming in to a paraboloidal antenna at an angle to the axis can be received just fine, or it can be just barely received depending upon the size of the angle. At approximately 15° from the axis the gain drops from substantially similar to the gain at the focal point, to substantially zero. Such sharp differences in reception over such a relatively small angle is a problem for which antenna designers and antenna installers must allow. Considering that steel structures sway (some of the tallest buildings sway as much as 10 inches) in high winds, such sway alone could rule out use of a parabolic antenna on top of such structures.

SUMMARY OF THE INVENTION

The above problems are solved, and a number of technical advances are achieved in the art, by a concave antenna that is substantially paraboloidal but has a larger focal point so that the gain of the antenna does not drop so sharply with respect to the angle the incoming wave front makes with the axis of the antenna.

In accordance with an embodiment of the invention, a concave antenna having an axis along which at least two focal points are located is provided. Each of the focal points corresponds to a portion of a respective parabolic antenna having an axis along the concave antenna axis and a respective focal point along the concave antenna axis. Each respective axis is skewed with respect to the other axes.

In accordance with another embodiment of the invention, a concave antenna having at least two axes along which at least two focal points are located. Each axis is not co-linear with any of the other axes. Each of the focal points corresponds to a portion of a respective parabolic antenna having a respective axis and a respective focal point along the respective axis. Each respective axis intersects with respect to one of the other axes.

In accordance with another embodiment of the invention, a concave antenna having at least two axes along which at least two focal points are located. Each axis is not co-linear with any of the other axes. Each of the focal points corresponds to a portion of a respective parabolic antenna having a respective axis and a respective focal point along the respective axis. Each respective axis is parallel with respect to one other axis.

In accordance with another aspect of the invention, a concave antenna having at least two axes along which at least two focal points arc located. Each axis is not co-linear with any of the other axes. Each of the focal points corresponds to a portion of a respective parabolic antenna having a respective axis and a respective focal point along the respective axis. Each respective axis is parallel with respect to one of the other axes.

BRIEF DESCRIPTION OF THE DRAWINGS

The foregoing advantageous features of the invention will be described in detail and other advantageous features will be made apparent upon reading the following detailed description that is given with reference to the several figures of the drawings, in which.

DETAILED DESCRIPTION

Figure 1:
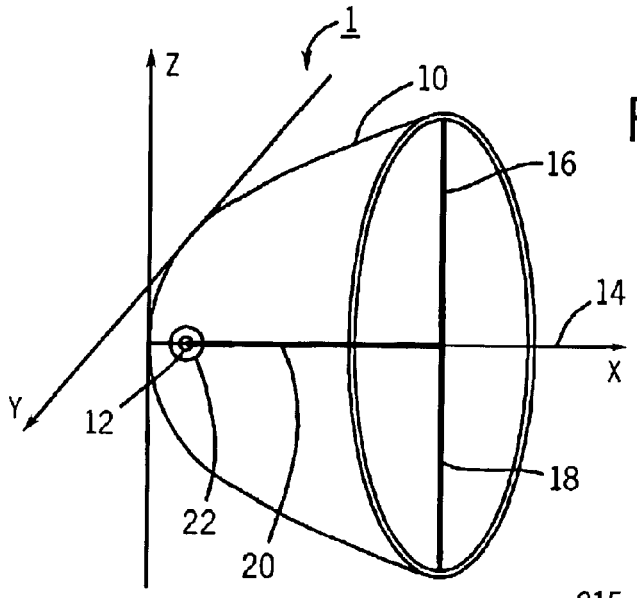
FIG. 1 shows a perspective view of a concave antenna that is a standard parabolioidal antenna, with an axis of symmetry and a collector located at a focal point thereof.

FIG. 1 shows a known example of a paraboidal reflector antenna 1 in a perspective view. The antenna 1 has a reflector 10 that is a parabola which is rotated circularly around the x-axis forming a shape of a 3-dimensional paraboloid. The x-axis is an axis of symmetry 14. Such a reflector 10 has a focal point 12 located along the x-axis. The focal point is where incoming electromagnetic, EM, radiation along the x-axis that is from a relatively far away source, far enough away so that the light waves are all in parallel to each other, is reflected to the focal point 12. The antenna 10 has supports 16 and 18 which arc made to be small to reduce any shadow effect each will have with respect to incoming EM radiation support member 20 extends along the axis of symmetry 14 from the supports 16, 18. At the support member 20 a small collector 22, which is located at the focal point to pickup the signal reflected to the focal point 12. The support 20 and the collector 22 arc also kept as small as practical in order to minimize their shadow effects have on the overall EM radiation that is collected. The antenna 1 is very efficient at collecting and concentrating EM radiation and/or signal directed to it. As mentioned above in the background, the antenna 1 has difficulty with signals that arc not parallel to the axis 14. Indeed, if the EM signal source is over 15 degree off of the axis, a substantial drop in signal strength occurs. Likewise if, because a wind or other environmental problem, the collector 22 strays too far from the axis of symmetry, there would be a substantial drop in the collected signal strength.

Figure 2:
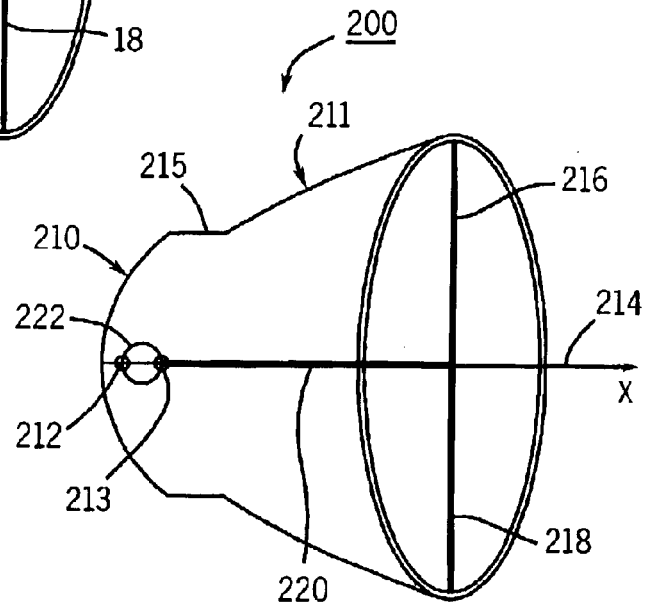
FIG. 2 shows a perspective view of a concave antenna having axial symmetry with a first portion having one focal point along the axis and a second portion having a second focal point along the axis.

Referring now to FIG. 2, one embodiment of the invention, reflector antenna 200, is shown in a perspective view. The reflector is made up of paraboloidal portion 210 and paraboidal portion 211. These two portions 210, 211 may be sections of a single paraboloid or sections of two paraboloids. Either way, each of the portions 210, 211 has a respective focal point 212, 213 located along the axis of symmetry 214. The two paraboloidal portions 210, 211 are joined by ring 215 which may be of a cylindrical shape or a truncated conical shape. The width and extent of ring 215 depends on the differences of the two portions 210, 211 and the desired differences in focal points 212, 213. When each of the portions is part of a single, larger paraboloidal reflector, as in FIG. 2, the ring 215 is approximately one wavelength of the reflected signal in length. If the reflected signal contains a band of frequencies, the ring 215 is set at one wavelength of the center frequency of the frequency band.

At the front of reflector portion 211 are supports 216 and 218. Connected to the supports 216 and 218 is a support 220. At a second end of support 220, a signal collector 222 is connected. This signal collector 222 is of sufficient size to collect signals reflected to focal point 212 and focal point 213. The collected signal is carried by a conductor (not shown), which either runs through the support 220 or along side of support 220. Once the conductor gets to support 216 or 218, it either runs through one support 216 or 218, or along side one of the supports 216, 218. With a collector 222 collecting at two focal points, the collected signal will be approximately the same as the reflector antenna 1 shown in FIG. 1, except the performance of the antenna 200 will provide less of a drop-off in signal power collected as the signal source moves away from the axis of symmetry 214.

Figure 3:
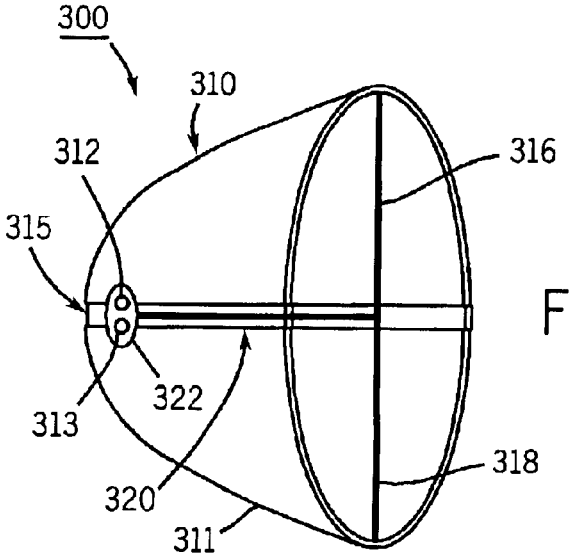
FIG. 3 shows a perspective view of a concave antenna having axial symmetry with a first portion having one focal point along a first axis and a second portion having a second focal point along a second axis parallel to the first axis.

Referring now to FIG. 3, another embodiment of the invention is shown in a perspective view. The reflector antenna 300 is generally a paraboloid in shape, but the paraboloid is bifurcated near the x-y plane. This plane was taken for ease of explanation, but any plane containing a line segment of the x-axis would have similar effects, only the focal points would have different locations. The reflector 300 is divided into two portions 310, 311. The two portions 310 and 311 are then held in a spaced relationship by a spacer 315. Each of the portions 310 and 311 has a respective focal point 312, 313. These focal points 312 and 313 are similarly maintained in a spaced relationship to each other by spacer 315. If the reflector antenna 300 is cut perfectly in half, each of the focal points 312, 313 will receive half of a far field reflected signal.

The reflector antenna 300 has supports 316, 318 to which is connected support 320. Support 320 is connected to a collector 322, which is sized sufficiently to collect signals reflected to focal points 312 and 313 by their respective portions 310, 311. Supports 316, 318 are sized have minimum shadow zones so as not to unnecessarily reduce the gain of the antenna 300. Supports 316 and 318 may be moved anywhere, such as to the front of the spacer 315. or to the rear of the spacer 315 (not shown in FIG. 3). If the supports 316 and 318 are at the rear, then the support 320 would extend from the rear to support the collector 322.

Bifurcating the antenna 300 into two portions 310, 311 held apart by the spacer 315 makes the antenna 300 have a broader sensitivity beam pattern in the vertical plane so any drop off from misalignment or weather related changes in the vertical plane will be less than a non-bifurcated antenna. If the cut were made along the z-axis (not shown) and a similar spacer installed, those of average skill in the antenna art will recognize that then everything in FIG. 3 will be rotated 90 degrees and the broadened beam pattern will be horizontal, instead of vertical. Such a mounting would be advantageous in high surface wind regions where antennas like this tend to oscillate in the horizontal plane.

Figure 4:
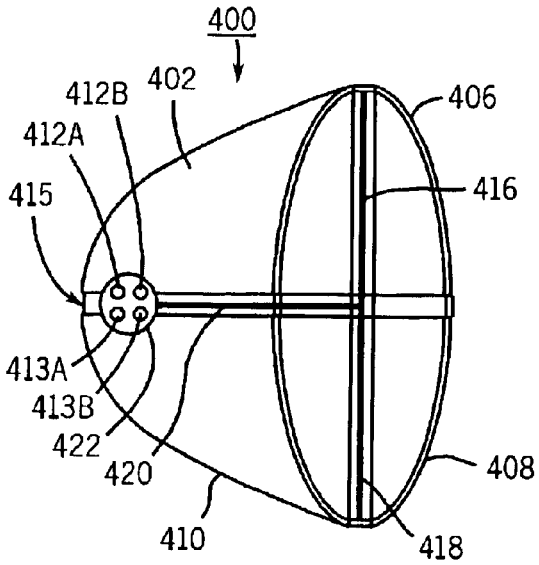
FIG. 4 shows a perspective view of a concave antenna that has four portions each portion being held in a spaced relationship to its closest adjacent portions by non-reflective spacers.

Referring now to FIG. 4, another embodiment of the invention is shown in a perspective view. The reflector antenna 400 shown in FIG. 4 is somewhat of a combination of the antennas shown in FIGS. 2 and 3, as will be described. Reflector antenna 400 is cut into four portions, though any number of sections would work, four makes a good example because of the symmetry with the previous figures. The four portions 404, 406, 408, 410 in this example are equal in size to each other, that is each is a quarter longitudinal portion of a paraboloid. Having them equal makes the description simpler, but one of average skill in this art should be able to expand this example to a more general, less symmetrical portions. The portions 404, 406, 408 and 410 are held in a spaced relationship with each other by spacer 415. Spacer 415 is approximately two parabolic strips, each being similar to spacer 315 in FIG. 3, but the two parabolic strips are at 90 degrees from each other and cross at the rear of the antenna 400. The crossing at the back of the spacer 415 is not completely simple because portions 404 and 408 are advanced in the x-direction by a fraction of a wavelength. Thus, by its geometry, antenna 400 has four separate focal points. Portion 404 has focal point 412B, portion 406 has focal point 412A, portion 408 has focal point 413B and portion 410 has focal point 413A.

Support members 416 and 418 are connected to the front of the antenna 400 and also to support 420. Support 420 i s connected to collector 422, which is sufficiently sized to collect signals at focal points 412A, 412B, 413A and 413B. With four focal points, the antenna 400 will have a sensitivity beamwidth that is broader than either antenna 200 or antenna 300. The overall gain at the center of the sensitivity beam will be slightly less, but the signal drop off rate because of misalignment by weather or installation will be at a slower rate.

Figure 5:
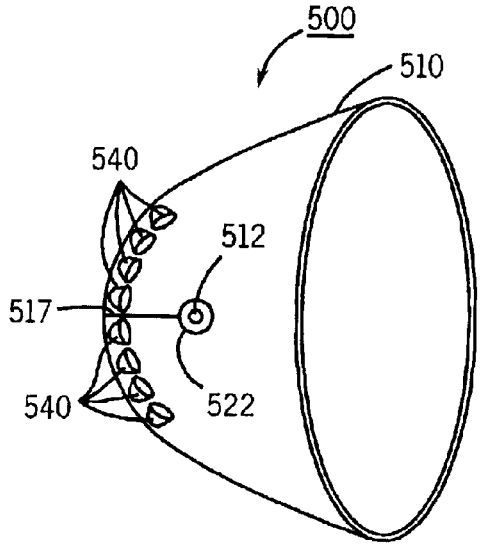
FIG. 5 shows a perspective view of a concave support structure supporting a plurality of small paraboloidal reflectors.

Referring now to FIG. 5, another embodiment of the invention is shown. In FIG. 5, an inside surface 510 of a concave antenna 500 is used for supporting a plurality of paraboloidal reflectors 540. These reflectors may be formed separately and then fastened to the inside surface 510, or the inside surface 510 and the subsurface below may have the paraboloidal reflectors 540 formed therein. The parabolodial reflectors 540 may be individually oriented to make as sharp or as large a focal point 512 as desired. At the back of th is antenna 500, a support 517 is connected thereto. At the other end of support 517 is a collector 522 which is sufficiently sized to collect all the signals reflected by the paraboloidal reflectors 540. As described above, in some conditions a larger focal point is more advantageous for an antenna that maximum gain.

Figure 6:
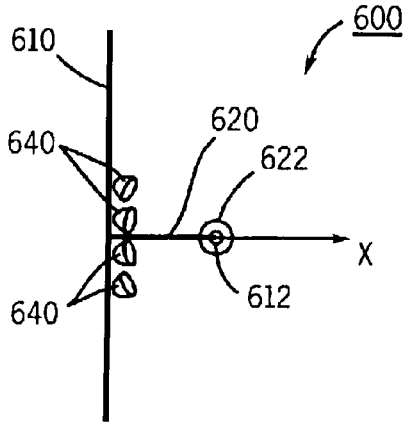
FIG. 6 shows a perspective view of a support structure supporting a plurality of small paraboloidal reflectors.

Referring now to FIG. 6, an antenna 600 is formed from a plane 610 having a sufficient depth to provide support for paraboloidal reflectors 640. Since plane 610 is flat, it is necessary to orient each of the paraboloidal reflectors 640 in a different direction in order to form the focal point 612. As with FIG. 5 above, the paraboloidal reflectors 640 may be made separately and then fastened to plane 610, or they may be formed in surface 610 and the depth of the support material below the surface 610. Each of the paraboloidal reflectors 640 is focused to the focal point 612, which may be as sharp or as broad as necessary. A support 620 is connected to the plane 610 at one end and at the other it is connected to a collector 622. Collector 622 is only as large as it needs to be to collect the signals reflected by the paraboloidal reflectors 640. This embodiment of the invention can take many forms depending on the ability to form or etch the reflectors 640.

While the specification in this invention is described in relation to certain implementations or embodiments, many details are set forth for the purpose of illustration. Thus, the foregoing merely illustrates the principles of the invention. For example, this invention may have other specific forms without departing from its spirit or essential characteristics. The described arrangements are illustrative and not restrictive. To those skilled in the art, the invention is susceptible to additional implementations or embodiments and certain of the details described in this application can be varied considerably without departing from the basic principles of the invention. It will thus be appreciated that those skilled in the art will be able to devise various arrangements which, although not explicitly described or shown herein, embody the principles of the invention are thus within its spirit and scope.

I claim:

1. A method of making a paraboloidal antenna with a larger focal point, comprising the steps of:

varying parameters of a paraboloid reflector from a true paraboloid shape over a portion of a reflecting surface of the paraboloid reflector resulting in a plurality of focal points displaced one or more distances from each other;

cutting the Paraboloid reflector with a plane into a first reflector portion having a true paraboloidal shape and a first focal point of the plurality of focal points and a second reflector portion having a true paraboloidal shape and a second focal point of the plurality of focal points, wherein the plane is substantially perpendicular or parallel to an axis of symmetry;

connecting the first reflector portion and the second reflector portion; and placing a collector that collects reflected signals at all the plurality of focal points.

2. The method of claim 1 wherein the plurality of focal points are all located on a common axis.

3. The method of claim 1 wherein the plurality of focal points are located on parallel axes.

4. The method of claim 1 wherein some of the plurality of focal points are located on a common axis and some of the plurality of focal points are located on parallel axes.

5. The method of claim 1 further comprising the step of providing support for the collector from an open end of the antenna.

6. The method of claim 1 further comprising the step of providing support for the collector from an end of the antenna opposite the open end.

7. The method of claim 1, wherein the step of cutting the paraboloid reflector with a plane into a first reflector portion having a true paraboloidal shape and a first focal point of the plurality of focal points and a second reflector portion having a true paraboloidal shape and a second focal point of the plurality of focal points comprises the steps of:

cutting at an end opposite to a closed end of the first reflector portion with a plane perpendicular to an axis of maximum signal pickup; and cutting at a closed end of the second reflector portion with the plane perpendicular to the axis of maximum signal pickup.

8. An antenna having a general parabolic shape, comprising:

a reflector that has a general paraboloid shape with variations from a true paraboloid shape over a portion of a reflector to provide a plurality of focal points displaced one or more distances from each other along an axis of maximum signal pick up; and a collector attached to the reflector that collects reflected signals at all the plurality of focal points;

wherein the paraboloid reflector is cut by a plane containing the axis of symmetry into two portions and each of the portions is held in a spaced relationship to the other portion thereby causing two focal points.

9. The antenna of claim 8, wherein the collector is sized such that all of the plurality of focal points can fit the collector when the collector is correctly attached.

10. The antenna of claim 9, wherein the collector is sized larger than required for all of the plurality of focal points to fit within the collector when the collector is correctly attached to provide for signal reception under any condition.

11. The antenna of claim 10 wherein the condition is a hurricane force wind.

12. The antenna of claim 10 wherein the condition is ice weighing the antenna out of alignment with an incoming signal.

13. The antenna of claim 10 wherein the condition is a physical mounting such that the axis of the antenna is not co-linear with the direction of an incoming signal to be collected.

14. The antenna of claim 8 wherein a first reflector portion having a true paraboloidal shape and a first focal point is cut by a plane perpendicular to the axis and connected to a second reflector having a true paraboloidal shape and second focal point along the axis, the first reflector portion being cut at the end opposite its closed end and the second reflector portion being cut at its closed end.

15. The antenna of claim 14 wherein any differences between the first paraboloidal reflector portion and the second paraboloidal reflector portion are filled with a mating ring there between.

16. The antenna of claim 8 wherein the paraboloidal reflector is cut by planes extending radically from the axis of symmetry into a plurality of portions and each of the plurality of portions is held in a spaced relationship to the nearest portions thereby causing a plurality of focal points.

17. The antenna of claim 8 wherein:

the paraboloidal reflector is cut by planes extending radically from the axis of symmetry into a plurality of portions;

at least one of the plurality of portions is displaced along the axis of symmetry and held in those locations relative to the nearest portions thereby causing a plurality of focal points along the original axis of symmetry.

18. The antenna of claim 8, wherein:

the paraboloidal reflector is cut by a plane containing the axis of symmetry into two portions;

one of the two portions is displaced along the axis of symmetry and held in those locations relative to the other portion thereby causing two focal points along the original axis of symmetry.

19. The antenna of claim 18, wherein:

the paraboloidal reflector is cut by a plane containing the axis of symmetry into two portions; and one of the two portions is displaced along the axis of symmetry and also is located in a spaced relationship with respect to the other portion thereby causing two focal points.

20. An antenna comprising:

a support structure;

a plurality of small paraboloids attached to the support structure;

each of the plurality of small paraboloids is oriented such that its focal point is at the same location as the others of the plurality of small paraboloids; and a collector collecting signals reflected by the plurality of small paraboloids and fastened firmly to the support structure.

21. The antenna of claim 20, wherein the support structure is a paraboloid.

22. The antenna of claim 20, wherein each of the plurality of small paraboloids has an opening that is less than a wave length of the lowest frequency it is designed to reflect to the collector.

23. The antenna of claim 20, wherein each of the plurality of small paraboloids has an opening that is less than a half wave length of the lowest frequency it is designed to reflect to the collector.

24. The antenna of claim 20, wherein each of the plurality of small paraboloids has an opening that is less than a quarter wave length of the lowest frequency it is designed to reflect to the collector.

* * * * *